United States Patent [19]
Andersson
[11] 4,317,524
[45] Mar. 2, 1982

[54] HYDRAULIC CRANES

[75] Inventor: Lars Y. Andersson, Forsa, Sweden
[73] Assignee: Hiab-Foco Aktiebolag, Sweden

[21] Appl. No.: 128,460
[22] Filed: Mar. 10, 1980
[30] Foreign Application Priority Data
Apr. 2, 1979 [SE] Sweden ..... 7902895
[51] Int. Cl.[3] ..... B66C 13/04
[52] U.S. Cl. ..... 212/146; 212/261; 414/138
[58] Field of Search ..... 414/138, 139; 212/146, 212/192, 222, 238, 261; 254/277

[56] References Cited

U.S. PATENT DOCUMENTS 3,884,359 5/1975 Suverkrop ..... 212/238 X
4,166,545 9/1979 Martinussen et al. ..... 414/138 X

*Primary Examiner*—Robert G. Sheridan
*Attorney, Agent, or Firm*—Newton, Hopkins & Ormsby

[57] ABSTRACT

An improved hydraulic crane comprising at least one lifting cylinder to pivot the crane arm in a vertical plane relative to the crane post. A pressure-fluid line associated with the cylinder is connected to a movement-damping accumulator. In addition, a non-return valve is inserted between the cylinder and the accumulator to allow flow of pressurized liquid in one direction only away from the cylinder. A drainage line is connected to the accumulator, said drainage line incorporating a pressure-limiting valve. Owing to this arrangement, any added loads that arise as a result of sudden, shock-like pressures may be absorbed upon pressure relief in the accumulator without imparting jerky return movements to the crane arms.

8 Claims, 5 Drawing Figures

HYDRAULIC CRANES

BACKGROUND OF THE INVENTION

When cargo is being handled by a hydraulic loading crane and, while being lowered at full speed, the crane arm is suddenly stopped, the added dynamic load on the crane arm, caused by its suddenly arrested motion, becomes considerable. Such added load must be reckoned with when the durability and strength of the loading crane is determined. One has attempted to reduce the added dynamic load and to make better use of the available loading capacity of the crane by connecting a gas accumulator to the load-supporting hydraulic cylinder. The gas accumulator is set to accommodate a pressure which is somewhat higher than that normally prevailing in the associated hydraulic system. The pressure increase generated by the added dynamic load in the cylinders and in the hydraulic system of the loading crane then forces into the accumulator the amount of hydraulic fluid that is required to retard the movements of the arm system for a length of time that is sufficient to reduce the added dynamic load to an acceptable level.

The pressure of the fluid thus forced into the accumulator is of a magnitude above the static pressure prevailing in the hydraulic system of the crane. Consequently, this amount of fluid returns to the hydraulic system when the retardation movement has ceased. This means that there is a temporary increase of the amount of fluid enclosed in the cylinder, and this increased amount of fluid forces the piston rod of the cylinder somewhat outwards, imparting a jerky return movement to the crane arm. These movements are, however, very small and as a rule they are negligible under normal conditions.

When working with loading cranes under special environmental conditions, such as is the case in loading operations with the aid of vessel-mounted loading cranes when loads are transferred from one boat to the other under heavy sea conditions, the added dynamic forces could, however, become quite considerable as a consequence of the pitching and rolling motions of the boat and they could reach such a magnitude that a considerably larger gas accumulator will be required. After a retardation process, such larger accumulators return a considerable amount of oil to the hydraulic cylinder involved, and the result is that the crane arm will perform a heavy return stroke. Since this return stroke will occur suddenly and without control, there is a great danger for injury to personnel and damage to material and equipment.

SUMMARY OF THE INVENTION

More precisely, the subject invention is concerned with hydraulic cranes of the kind wherein the lifting arm is journalled for pivotal movement in a vertical plane by means of a lifting cylinder, said cylinder being connected to a hydraulic pump via a first line, in which line is inserted a hand valve and to which line a dampening accumulator is connected via a second line.

It is characteristic of the invention that a non-return valve is inserted in said second line connecting the accumulator to said first line, said non-return valve allowing flow of pressurized fluid in one direction only, away from the lifting cylinder, and in that to the accumulator is connected a drainage line in which a pressure-limiting valve is inserted, this valve arranged to open in response to a temporary excess pressure in the accumulator for relief of pressure to the drainage line. Owing to the provision and arrangement of said non-return valve, the accumulator, which is charged by the pressure shock emanating from the crane arm, is prevented from sending a pressure wave back to the air cylinder when the load is relieved. Consequently, uncontrolled return movements of the crane arm are positively prevented.

BRIEF DESCRIPTION OF THE DRAWINGS

The invention will be described in closer detail in the following with reference to the accompanying drawings, wherein.

DETAILED DESCRIPTION OF A PREFERRED EMBODIMENT

Figure 1:
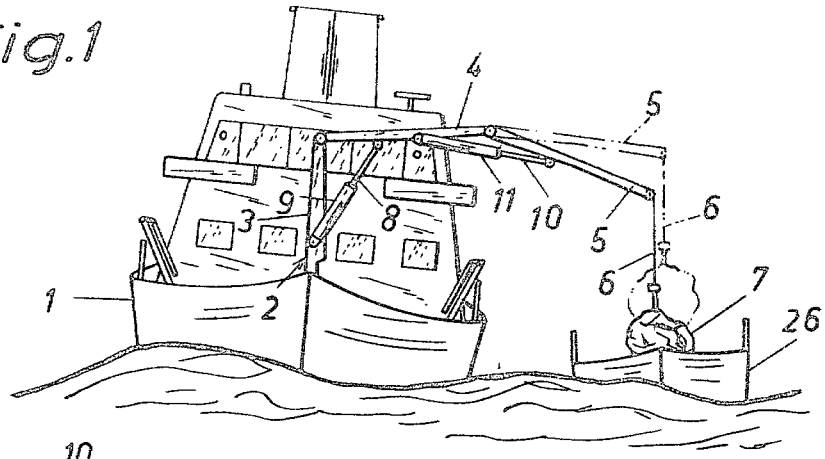
FIG. 1 is a lateral view of a crane mounted on a vessel and showing the crane while performing loading and unloading work from one boat to another.

FIG. 1 illustrates a crane 2 which is mounted on a vessel 1 and which comprises a crane post 3 on which is pivotally mounted on arm 4, a rocker arm 5 being mounted at the outer end of arm 4 for pivotal movement. A cable 6 is secured to the outer end of the rocker arm 5 so as to support a lifting tool 7. A piston-and-cylinder unit 8, 9 is provided to pivot the arm 4 in a vertical plane and a second piston-and-cylinder unit 10, 11 is provided to pivot the rocker arm 5.

Figure 2:
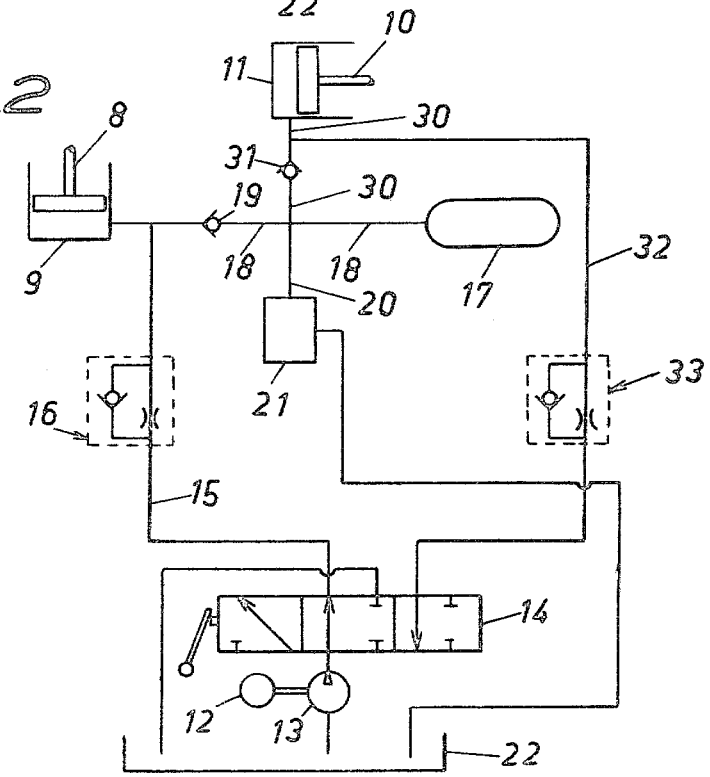

FIG. 2 illustrates a coupling diagram related to the hydraulic system incorporating the lifting cylinder 9 and the rocker arm cylinder 11. Pressurized oil is conducted from a hydraulic pump 13, driven by a motor 12, through a hand valve 14 and via a line 15 which comprises a constant-flow valve 16 to the cylinder 9. A line 18 connects the cylinder 9 to an accumulator 17, said line 18 comprising a non-return valve 19 allowing pressurized oil to flow in one direction only away from the lifting cylinder 9. A drainage line 20 is connected to the line 18 and in the line 20 is inserted a pressure-limiting valve 21. The drainage line 20 debouches into a reservoir 22 holding the pressurized oil.

Figure 4:
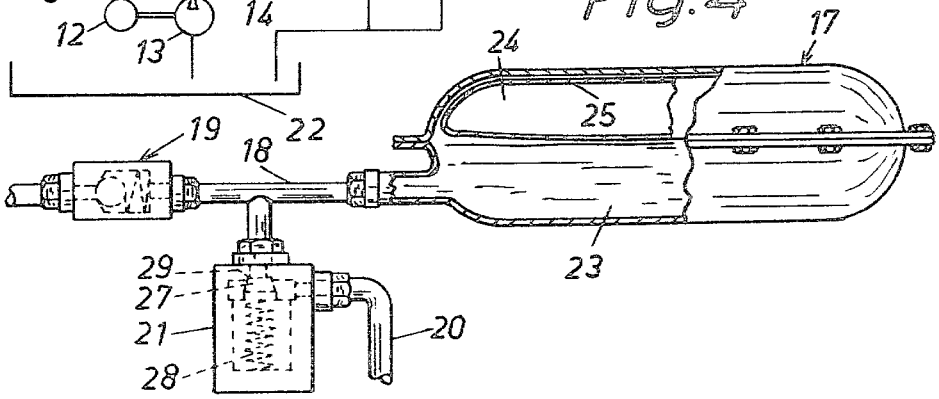
FIG. 4 shows on a larger scale and partly in cross-section an accumulator, a non-return valve, and a pressure-limiting valve, incorporated in the pressure-line system.

FIG. 4 illustrates the accumulator on an enlarged scale and in a partly cut lateral view. In accordance with the embodiment illustrated, the accumulator consists of a closed bladder 25 which is filled with gas 24 and which is housed in a chamber 23. The bladder wall consists of rubber, non-rigid plastics or some other suitable, elastic material.

When the crane 2 is used for transfer of loads onto and from a boat 26, and—particularly at high sea—a shock pressure is generated in the lifting cylinder 9 as a result of abnormal stresses exerted on the crane arms 4, 5 under such circumstances, the non-return valve 19 opens rapidly, whereby oil is forced into the accumulator 17 while compressing the gas 24 in the bladder 25. When the pressure is relieved, the bladder forces the oil back into the line 18. However, this amount of oil cannot be forced back into the lifting cylinder but instead it opens the pressure-limiting valve 21, that is, it displaces the valve piston 27 of said valve against the action of a spring 28 away from the seat 29 thereof. The design of the valve will be described in closer detail in the following with reference to FIG. 5. As a result of this displacement the amount of oil forced out of the lifting cylinder 9 as a consequence of the shock pressure will be allowed to flow through the drainage line 20 and into the reservoir 22. Consequently, the crane arms are prevented from performing any jerky return movements when the pressure relief takes place.

FIG. 2 likewise shows that also the rocker arm cylinder 11 is connected to the accumulator 17 via a line 30. Also line 30 comprises a non-return valve 31 allowing flow of pressure oil in one direction only, away from the cylinder 11. A constant-flow valve 33 is inserted in a line 32 leading from the hand valve 14 to the rocker-arm cylinder 11.

It should be obvious that when a shock load is exerted on the rocker arm cylinder 11, oil will be forced via the non-return valve 31 and the line 18 into the accumulator 17. Upon the subsequent pressure relief, the accumulator will force the amount of oil involved to the oil reservoir 22 via the drainage line 20 and the pressure-limiting valve 21. Also the rocker arm 5 will therefore be prevented from performing uncontrolled jerky return movements.

Figure 5:
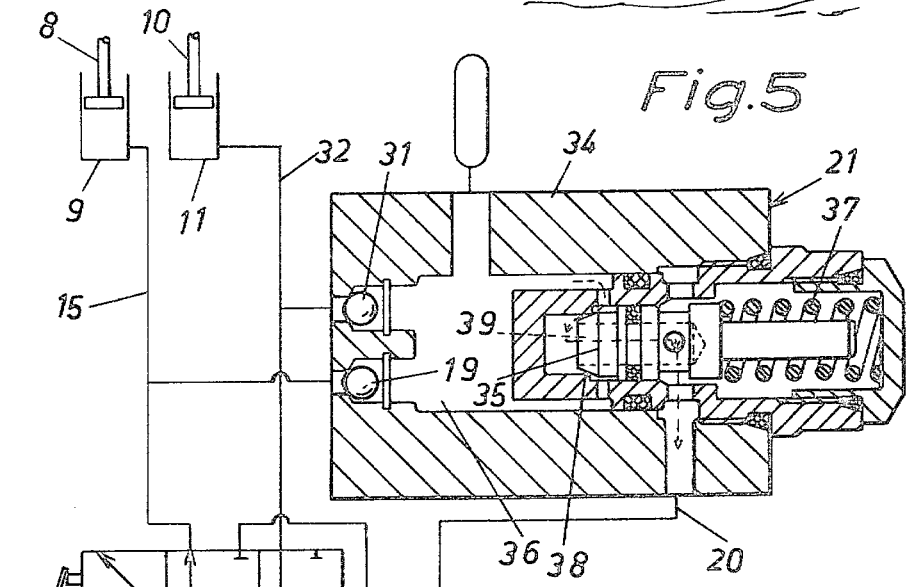
FIG. 5 is a longitudinal section through a pressure-limiting valve controlled via a differential means.

FIG. 5 is a longitudinal view of a valve housing 34 enclosing in addition to the two non-return valves 19 and 31 also a differential-controlled pressure-limiting valve. The valve body 35 of this pressure-limiting valve is forced away from its seat 38 against the action of a helical spring 37 upon the generation of a shock pressure inside the chamber 36 and as a result of its movement it allows oil to pass via an axial boring 39 formed in the valve body 35 (see the arrows in FIG. 5) through the drainage line 20 and to the reservoir 22.

Figure 3:
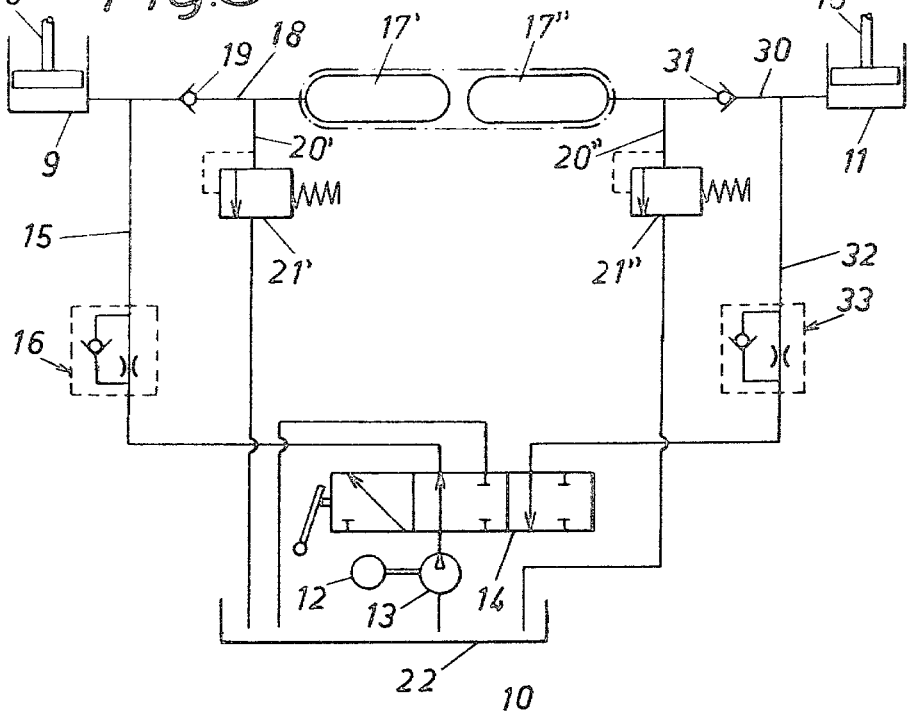
FIGS. 2 and 3 illustrate two different coupling diagrams showing the arrangement of the pressure-line system for the hydraulic cranes in accordance with the invention.

FIG. 3 illustrates a coupling diagram in accordance with an alternative embodiment. In this case one accumulator 17' is used to dampen the movements of the lifting cylinder 9 and another accumulator 17'' is used to dampen the movements of the rocker-arm cylinder 11. When using two hydraulic line systems which operate independently of one another, one achieves a more even dampening of the shock pressure in both cylinders 9, 11. FIG. 3 also shows the provision of pilot-controlled regulating valves 21' and 21'' mounted in the drainage lines 20' and 20''. Because of the pilot pressure, the valve bodies of these regulating valves remain in their open positions also in the event of pressure variations in the lines 20' and 20'' emanating from the accumulators 17' or 17''. In all other respects, the coupling diagram is in conformity with the one shown in FIG. 2.

If desired, the accumulators 17' and 17'' can be replaced by one single accumulator with the lines 20' and 20'' connected to opposite ends of the accumulator. This alternative is indicated in dash-and-dot lines.

The following dimensions are given by way of example for a crane of a capacity of approximately 11,000 kpm:

The accumulator 17 should have a volume that is approximately equal to that of the lifting cylinder 9 or the rocker-arm cylinder 11, that is about 7 liters.

The pre-load on the accumulator should be between 80 and 100% of the normal working pressure of the crane.

The pressure drop of the non-return valve 19 should not exceed 2 bars for a through-flow of approximately 100 liters of oil per minute.

The pressure-relief valve 21 should be set to approximately 3 Mega-Pascal (MPa) above the normal operational pressure in the hydraulic system.

In a crane dimensioned as indicated above an amount of oil of appr. 0.3 to 0.4 liters will be forced into the accumulator, when the crane arm is exposed to shock loads. If the same amount of oil were allowed, upon relief of pressure, to be present back into the lifting cylinder, this would mean that the outer end of the crane arm would pivot upwards in a completely uncontrolled manner over a distance of approximately 0.5 meters. Owing to the provision of the non-return valve such jerky return movements of the crane arms are positively prevented. Also the pressure-limiting valve 21 has a dampening effect because the pressure oil flowing from the accumulator 17 will be forced through the valve while changing its directions several times.

The embodiments as shown in the drawings and described in the aforegoing are merely examples and it should be understood that the accumulator 17 as well as the non-return valve 19 and the pressure-limiting valve 21 may be constructively altered in a variety of ways within the scope of the invention. The crane could be used for a variety of purposes and applications wherein it is exposed to extreme added loads. As one example could be mentioned the advantageous use of the crane in accordance with the invention on fishing boats and trawlers to cast and lift nets and other fishing equipment when the sea is heavy.

What I claim is:

1. An improved hydraulic crane, comprising a crane post, a lifting arm journalled on said crane post, a lifting cylinder arranged to pivot said lifting arm in a vertical plane, a hydraulic pump, said cylinder connected to said hydraulic pump via a first hydraulic line, a hand valve inserted in said hydraulic line, and a dampening accumulator connected to said first hydraulic line via a second hydraulic line, the improvement comprising a non-return valve inserted in said second hydraulic line connecting said accumulator to said first hydraulic line, said non-return valve allowing flow of pressurized fluid only in the direction away from said lifting cylinder, and a drainage line, said drainage line connected to said accumulator, a pressure-limiting valve inserted in said drainage line and arranged to open in response to a temporary excess pressure in said accumulator for relief of pressure to said drainage line.

2. An improved hydraulic crane as claimed in claim 1, wherein a rocker arm is mounted at the outer end of said lifting arm, a second lifting cylinder arranged to pivot said rocker arm in a vertical plane, the improvement comprising a pressure-fluid line associated with said second cylinder, a third hydraulic line connected with said accumulator, said pressure-fluid line connected to said third hydraulic line, a non-return valve inserted in said third hydraulic line, said non-return valve allowing flow of pressurized fluid only in the direction away from said second lifting cylinder.

3. An improved hydraulic crane as claimed in claim 1, wherein a rocker arm is mounted at the outer end of said lifting arm, a second lifting cylinder arranged to pivot said rocker arm in a vertical plane, the improvement comprising a pressure-fluid line associated with said second cylinder, a second accumulator, separate from said first accumulator, said second accumulator connected via a third hydraulic line having a non-return valve therein and connected with said pressure-fluid line associated with said second rocker-arm cylinder, and a drainage line connected to said third hydraulic line between said non-return valve and said second accumulator, a pressure-limiting valve inserted in said drainage line.

4. A hydraulic system which is subject to sudden shock loading pressure comprising in combination:

a hydraulic pump;

a hydraulic lift cylinder operatively connected to said pump via a first hydraulic line having a hand valve disposed therein for controlling fluid flow between said pump and said cylinder, said cylinder being subject to sudden shock loading;

an accumulator operatively connected to said first hydraulic line intermediate said hand valve and said cylinder via a second hydraulic line having a non-return valve disposed therein for allowing fluid flow only in a direction away from said cylinder, said accumulator having a drainage line including a pressure-limiting valve whereby said pressure-limiting valve opens in response to any temporary excess pressure in said accumulator due to shock loading of said cylinder and relieves the pressure through said drainage line.

5. A hydraulic crane, comprising in combination:

a crane post;

a lifting arm pivotally connected to said crane post;

a hydraulic cylinder operatively connected to said arm and said post for pivoting said arm in a vertical plane, said arm being subject to sudden shock loading;

a hydraulic pump operatively connected to said cylinder via a first hydraulic line having a hand valve therein for controlling fluid flow through said first line between said pump and said cylinder to move said arm;

an accumulator operatively connected to said first line intermediate said hand valve and said cylinder via a second hydraulic line having a non-return valve therein allowing fluid flow only in a direction away from said cylinder, said accumulator having a drainage line with a pressure-limiting valve therein whereby said pressure-limiting valve opens in response to any temporary pressure in said accumulator caused by shock loading on said crane to relieve the excess pressure through said drainage line.

6. A hydraulic system for a loading crane which is subject to sudden shock loading, comprising in combination:

a hydraulic pump;

a hydraulic lift cylinder for actuating said crane, operatively connected to said pump via a first hydraulic line having a hand valve therein for controlling fluid flow through said first line between said pump and said cylinder, said cylinder being subject to shock loading;

an accumulator operatively connected to said first hydraulic line intermediate said cylinder and said hand valve via a second hydraulic line having a non-return valve therein for allowing fluid flow therethrough only in a direction away from said cylinder, said accumulator having a drainage line with a pressure-limiting valve therein whereby any temporary excess pressure in said accumulator due to shock loading of said cylinder opens said pressure-limiting valve to relieve the pressure through said drainage line.

7. In a hydraulic crane having a hydraulic piston/cylinder device of predetermined volumetric capacity and accumulator means hydraulically connected to said device for cushioning sudden increases in hydraulic pressure imposed upon said device, said accumulator means having a volumetric cushioning capacity which is at least in the order of said predetermined volumetric capacity of the piston/cylinder device, the improvement which comprises:

check valve means hydraulically connected between said accumulator means and said piston/cylinder device for allowing hydraulic fluid flow toward said accumulator means and preventing return hydraulic flow from said accumulator means to said device whereby to trap hydraulic fluid in the accumulator means during a cushioning action thereof; and means responsive to attainment of a predetermined pressure within said accumulator means for draining trapped hydraulic fluid therefrom.

8. An improved hydraulic crane as claimed in claim 1, wherein a rocker arm is mounted at the outer end of said lifting arm, a second lifting cylinder arranged to pivot said rocker arm in a vertical plane, the improvement comprising a pressure-fluid line associated with said second cylinder, a third hydraulic line connected with said accumulator, said pressure-fluid line connected to said third hydraulic line, a non-return valve inserted in said third hydraulic line, said non-return valve allowing flow of pressurized fluid only in the direction away from said second lifting cylinder a drainage line connected to said third hydraulic line between said non-return valve and said accumulator, a pressure-limiting valve inserted in said drainage line.

* * * * *